US009008819B2

(12) United States Patent
Banno et al.

(10) Patent No.: US 9,008,819 B2
(45) Date of Patent: Apr. 14, 2015

(54) AUTOMATIC POURING METHOD AND FACILITY THEREFOR

(75) Inventors: Kouichi Banno, Nagoya (JP); Tadashi Nishida, Nagoya (JP)

(73) Assignees: Sintokogio, Ltd., Aichi (JP); Fujiwa Denki Co., Ltd., Aichi (JP)

( * ) Notice: Subject to any disclaimer, the term of this patent is extended or adjusted under 35 U.S.C. 154(b) by 788 days.

(21) Appl. No.: 13/378,606

(22) PCT Filed: Mar. 25, 2010

(86) PCT No.: PCT/JP2010/055174

§ 371 (c)(1),
(2), (4) Date: Mar. 2, 2012

(87) PCT Pub. No.: WO2010/146909

PCT Pub. Date: Dec. 23, 2010

(65) Prior Publication Data

US 2012/0173009 A1 Jul. 5, 2012

(30) Foreign Application Priority Data

Jun. 16, 2009 (JP) ..... 2009-143077
Jan. 26, 2010 (JP) ..... 2010-013798

(51) Int. Cl.

| | |
|---|---|
| ***G06F 19/00*** | (2011.01) |
| ***B22D 39/04*** | (2006.01) |
| ***B22D 41/04*** | (2006.01) |
| ***B22D 47/00*** | (2006.01) |

(52) U.S. Cl.
CPC ..... *B22D 39/04* (2013.01); *B22D 41/04* (2013.01); *B22D 47/00* (2013.01)

(58) Field of Classification Search
USPC ..... 700/103, 146, 150
See application file for complete search history.

(56) References Cited

U.S. PATENT DOCUMENTS 4,600,047 A * 7/1986 Matoba et al. ..... 164/453

FOREIGN PATENT DOCUMENTS

JP 01-262064 10/1989

(Continued)
OTHER PUBLICATIONS

International Search Report dated May 25, 2010 issued in corresponding International Application No. PCT/JP2010/055174.

*Primary Examiner* — Kenneth Lo
*Assistant Examiner* — Chad Rapp
(74) *Attorney, Agent, or Firm* — Finnegan, Henderson, Farabow, Garrett & Dunner, L.L.P.

(57) ABSTRACT

Provided herein is an automatic pouring method and equipment for the same that enable to inhibit the generation of residual molten metal in a ladle and thus the molten metal to be discharged therefrom can be eliminated. The method includes the steps of determining a set weight of the molten metal to be received in the ladle and number of pieces of the molds that could be poured with the ladle based on data on assigned numbers of respective molds to be poured, types of products to be cast, and set weights of the molten metal to be poured, receiving a weight of the molten metal that is greater than the set weight of the molten metal in the ladle, deriving a difference in weight between the actual weight of the molten metal that is received in the ladle and the set weight of the molten metal in the ladle, deriving a target weight of the molten metal to be poured by adding a part of the derived difference in weight to the set weight of the molten metal to be poured into the mold to be poured, and pouring the molten metal into the mold to be poured to target the target weight of the molten metal to be poured. The pouring of the molten metal is repeated by number of times that equals to the number of pieces of the molds that could be poured with the ladle such that the ladle would be emptied when the last mold in the number of pieces of the molds that could be poured with the ladle is poured.

7 Claims, 2 Drawing Sheets

(56) References Cited

FOREIGN PATENT DOCUMENTS

| | | |
|---|---|---|
| JP | 04-046665 | 2/1992 |
| JP | 11-207458 | 8/1999 |
| JP | 2000-102859 | 4/2000 |

* cited by examiner

AUTOMATIC POURING METHOD AND FACILITY THEREFOR

TECHNICAL FIELD

This invention relates an automatic pouring method, for instance, in a foundry, or automatic pouring molten metal into a mold and equipment for the same.

BACKGROUND

Conventionally, for instance, in a foundry, an automatic pouring machine for automatically pouring molten metal from a ladle into a mold by tilting the ladle is used to carry out that automatic pouring. In this case, one known method includes the steps of presetting necessary volumes of the molten metal to be poured for respective types of casting products, and carrying out pouring the molten metal using the preset necessary volume as target volumes of the molten metal to be poured (see, e.g., Patent Literature 1).

PRIOR ART LITERATURE

Patent Literature

[Patent Literature 1] Japanese Patent Laid-open Publication No. 04-46665 (Mazda Motor Corporation)

SUMMARY OF THE INVENTION

Problems to be Solved by the Invention

However, the capacity of one ladle for holding the molten metal is limited capacity for holding the molten metal. Therefore, even if in the first several times of pouring the molten metal the respective target volumes of the molten metal to poured, would be complied with the remaining molten metal in the ladle in the last of pour may often be less than the target volume. In such a situation, the pour would not be carried out and thus the remaining molten metal in the ladle should be drained in an extra process. This results in an investment of time to drain the remaining molten metal and thus involves a problem in which the cycle time of equipment for delivering the molten metal may be lengthened. Further, because the molten metal that has been used to melt it should be drained, i.e., disposed of there is a problem of an increase in the amount of disposed molten metal.

The present invention that is made in view of the foregoing situations aims to provide an automatic pouring method and equipment for the same that enables the inhibition of the occurring of the residual molten metal in the ladle such that the molten metal to be discharged therefrom can be eliminated.

Means to Solve the Problem

To achieve the above objective, an automatic pouring method of the present invention uses an automatic pouring machine for tilting a ladle that stores molten metal therein to pour the molten metal therefrom into a specified mold of a group of molds that are intermittently conveyed and a controlling means for controlling the automatic pouring machine. The automatic pouring method comprises the steps of;

providing data on assigned numbers of the respective molds to be poured in the group of the molds, types of products to be cast, and set weights of the molten metal to be poured, to the controlling means;

determining a set weight of the molten metal to be received by the ladle and the number of pieces of the molds that could be poured with the ladle by means of the controlling means based on the provided data on the assigned numbers of the respective molds to be poured in the group of the molds, the types of products to be cast, and the set weights of the molten metal to be poured;

receiving a weight of the molten metal that is greater than the set weight of the molten metal in the ladle;

deriving a difference in weight between the actual weight of the molten metal that is received in the ladle and the set weight of the molten metal in the ladle;

deriving a target weight of the molten metal to be poured by adding a part of the derived difference in weight between the actual weight of the molten metal in the ladle and the set weight of the molten metal in the ladle to the set weight of the molten metal to be poured into the mold to be poured;

tilting the ladle to pour the molten metal into the mold to be poured to target the target weight of the molten metal to be poured; and repeating the pouring of the molten metal a number of times that equals to the number of pieces of the molds that could be poured with the ladle such that the ladle would be emptied when the last mold in the number of pieces of the molds that could be poured with the ladle has been poured.

Further, automatic pouring equipment of the present invention comprises:

a melting furnace for melting each of various metals into molten metal;

an automatic pouring machine for tilting a ladle that stores molten metal therein to pour the molten metal therefrom into a specified mold of a group of molds that are intermittently conveyed;

a truck for conveying the ladle between the melting furnace and the automatic pouring machine; and a controlling means for controlling the melting furnace, the truck, and the automatic pouring machine;

characterized in that the controlling means comprises:

an input circuit for receiving data on assigned numbers of the respective molds to be poured in the group of the molds, types of products to be cast, and set weights of the molten metal to be poured, to the controlling means;

a decision circuit for determining a set weight of the molten metal to be received by the ladle from the melting furnace and a number of pieces of the molds that could be poured with the ladle based on the provided data on the assigned numbers of the respective molds to be poured in the group of the molds, the types of products to be cast, and the set weights of the molten metal to be poured;

a controlling circuit for controlling the tilting motion of the melting furnace such that the ladle receives therefrom the molten metal in the set weight of the molten metal;

a first arithmetic circuit for deriving the difference in weight between the actual weight of the molten metal that is received in the ladle and the set weight of the molten metal to be received in the ladle;

a second arithmetic circuit for deriving the target weight of the molten metal to be poured by adding a part of the derived difference in weight between the actual weight of the molten metal in the ladle and the set weight of the molten metal to be received in the ladle to the set weight of the molten metal to be poured into the mold to be poured; and a pouring circuit for tilting the ladle to pour the molten metal into the mold to be poured to target the target weight of the molten metal to be poured;

wherein the pouring of the molten metal is repeated a number of times that equals to the number of pieces of the molds that could be poured with the ladle, thereby the ladle would be emptied when the last mold in the number of pieces of the molds that could be poured with the ladle is poured.

In the automatic pouring method and equipment of the present invention, the part of the difference in weight between the actual weight of the molten metal in the ladle and the set weight of the molten metal in the ladle to be added to the set weight of the molten metal to be poured into the mold to be poured preferably refers to a value that is obtained by dividing the difference in weight between the actual weight of the molten metal in the ladle and the set weight of the molten metal in the ladle by the number of pieces of the molds that could be poured with the ladle.

Advantage of the Invention

With the automatic pouring method and equipment that are configured as described above, the pouring of the molten metal is repeated a number of times that equals to the number of pieces of the molds that could be poured with the ladle such that the ladle would be emptied when the last mold in the number of pieces of the molds that could be poured with the ladle is poured. This results in various advantages, for instance, the occurring of the residual molten metal in the ladle is inhibited such that the molten metal to be discharged therefrom can be eliminated.

BRIEF DESCRIPTION OF THE DRAWINGS

The accompanying drawings, which are incorporated in and constitute a part of the specification, schematically illustrate a preferred embodiment of the present invention, and together with the general description given above and the detailed description of the preferred embodiment given below, serve to explain the principles of the present invention.

EMBODIMENT TO CARRY OUT THE INVENTION

Figure 1:
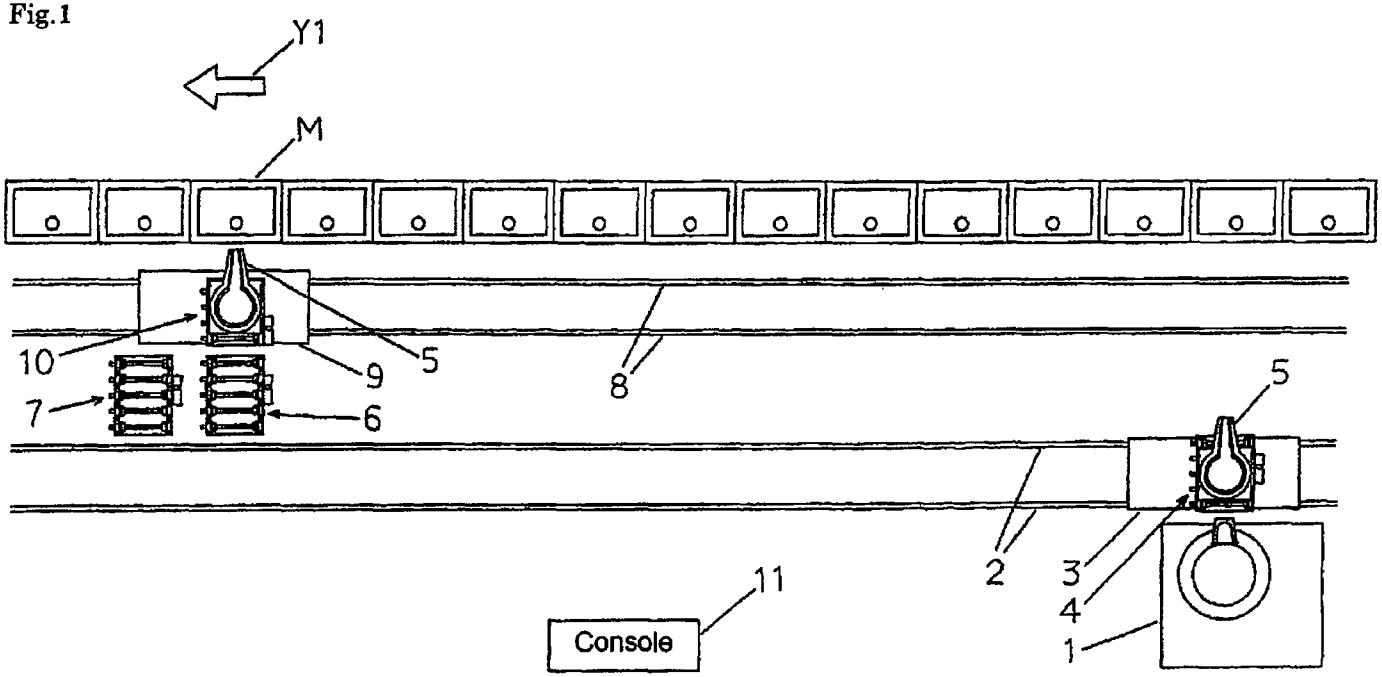
FIG. 1 is a plane view schematically illustrating the automatic pouring equipment of an embodiment of the present invention.

With reference to drawings, an embodiment of the present invention will be explained in detail. As illustrated in FIG. 1, exterior to a melting furnace 1 for melting various metals, first rails 2 are laid with an interval therebetween such that a ladle-transferring truck 3 is loaded thereon to travel along them. The ladle-transferring truck 3 is provided with a first driven roller conveyor 4 on which a ladle 5 is loaded on and loaded off. Also, the ladle-transferring truck 3 is equipped with a means for measuring weight, typically, a load cell (not shown) such that the load cell measures the weight of molten metal in the ladle 5. The ladle-transferring truck 3 conveys the ladle 5 between the melting furnace 1 and an automatic pouring machine 9, which is described below.

Outside the first rails 2, a third driven roller conveyor 6 and a fourth driven roller conveyor 7 are arranged. Outside the third and fourth driven roller conveyors 6 and 7, second rails 8 are laid with an interval therebetween such that the automatic pouring machine 9 is loaded thereon to travel along them. The automatic pouring machine 9 is provided with a second driven roller conveyor 10 on which the ladle 5 is loaded on and loaded off. Also, the automatic pouring machine 9 is equipped with a means for measuring weight, typically, a load cell (not shown) such that the load cell measures the weight of molten metal in the ladle 5.

Outside the automatic pouring machine 9, one group of molds M that is molded from a molding machine (not shown) is intermittently conveyed in the direction denoted by an arrow Y1, by means of a conveying means (not shown) for conveying the molds such that the group of the molds M is conveyed one pitch (corresponding to the length of one mold M). In this embodiment, each mold is a tight-flask mold that is molded from a horizontally parted tight-flask molding machine. Numeral 11 denotes a console (a controlling means) for controlling respectively, the melting furnace, the ladle-transferring truck, and the automatic pouring machine, respectively. The console 11 includes various circuits as described below.

The operation of the above configuration will be explained. First, provided to an input circuit of the console 11 is a set of data on assigned numbers that are assigned to the respective molds of the group of the molds M to be poured, types of products to be cast, and set weights of the molten metal to be poured. The input circuit may be configured to receive, for instance, the above data that are transmitted from outside.

Then, a decision circuit determines set weights of the molten metal to be received by the ladle 5 and the number of molds that could be poured by the ladle 5, in response to the received data on the assigned numbers of the respective molds of the group of the molds M to be poured, the types of the products, and the set weights of the molten metal to be poured. This determination is below described in detail.

Figure 2:
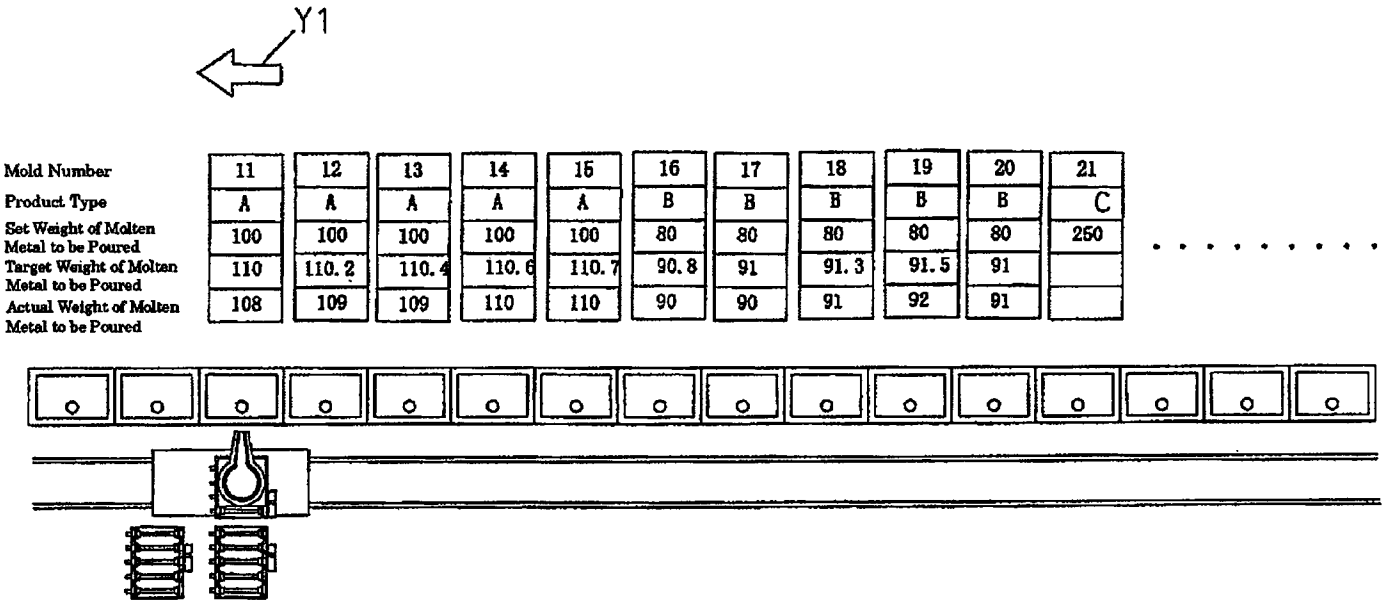
FIG. 2 shows an example of a set of data on the assigned numbers of the respective molds, the types of the products to be cast, the set weights of the molten metal to be poured, the target weights of the molten metal to be poured, and the actual weights of the molten metal that is actually poured.

FIG. 2 shows the data on the assigned numbers of the respective molds M to be poured from now, the types of the products, and the set weights of the molten metal to be poured. The capacity of the ladle 5 in this embodiment is 1100 kg. A calculation based on the data, in which each mold of the assigned numbers 11 to 15 corresponds to a product A with a set weight of 100 kg and each mold of the assigned numbers 16 to 20 corresponds to a product B with a set weight of 80 kg, derives (100 kg×5)+(80 kg×5)=900 kg. If 250 kg of the set weight of the mold denoted by the assigned number 21 adds to this sum, the total weight would be 1150 kg and thus would exceeded the capacity of the ladle 5. Accordingly, the set weight of the molten metal to be received by the ladle 5 is determined to be 900 kg, while the number of molds that can be poured by the ladle 5 is determined to be 10, which constitutes the products A that have the assigned numbers 11 to 15 and the products B that have the assigned numbers 16 to 20.

The melting furnace 1 is forwardly tilted by means of a tilting means (not shown) for tilting the melting furnace such that the molten metal is fed into the ladle 5 that has been loaded on the first driven roller conveyor 4. Feeding of the molten metal is continued until the weight of the molten metal in the ladle 5 achieves 900 kg of the set weight of the molten metal. The melting furnace 1 is then inversely tilted by the tilting means (not shown). This tilting movement is carried out in response to a signal from the controlling circuit such that the ladle 5 receives the set weight of the molten metal from the melting furnace 1.

If an operator drops an alloy in or removes slugs from the ladle 5 on the first driven roller conveyor 4 to adjust the composition of the molten metal, the weight of the molten metal in the ladle 5 would exceed the set weight of the molten metal. Namely, a weight of the molten metal that exceeds the set weight would be received in the ladle 5. In this embodiment, the weight of the molten metal in the ladle 5 at present, i.e., the actual weight of the molten metal that is actually received in the ladle 5 is assumed to be 1,000 kg.

The ladle-transferring truck 3 is then moved by a driving means (not shown) to replace the ladle 5 on the first driven roller conveyor 4 to the immediate front side of the fourth driven roller conveyor 7. The driving means (not shown) of the respective first and fourth driven-roller conveyors 4 and 7 are then actuated such that the ladle 5 on the first driven-roller conveyor 4 is loaded on the fourth driven-roller conveyor 7 therefrom. The ladle-transferring truck 3 is then moved by the driving means (not shown) to replace the first driven roller conveyor 4 to the immediate front side of the third driven roller conveyor 6. The driving means (not shown) of the respective second and third driven-roller conveyors 10 and 6 and the driving means (not shown) of the first driven-roller conveyor 4 are then actuated such that the empty ladle 5 on the second driven-roller conveyor 10 is loaded on the first driven-roller conveyor 4, passes through above the third driven roller conveyor 6. The ladle-transferring truck 3 is then moved by the driving means (not shown) to replace the empty ladle 5 on the first driven roller conveyor 4 to return to outside the melting furnace 1.

The automatic pouring machine 9 is moved by means of a driving means (not shown) to move the second driven roller conveyor 10 to behind the fourth driven roller conveyor 7. The driving means (not shown) of the respective fourth and second driven roller conveyors 7 and 10 are then actuated such that the ladle 5, which holds the molten metal therein, on the fourth driven-roller conveyor 7 is loaded on the second driven-roller conveyor 10.

In the console 11, a first arithmetic circuit then derives the difference between the actual weight of the molten metal that is received in the ladle 5 and the set weight of the molten metal. In this embodiment, because the actual weight of the molten metal is 1,000 kg and the set weight of the molten metal is 900 kg, the difference would be 1,000 kg-900 kg=100 kg.

In the console 11, a second arithmetic circuit then derives the target weight of the molten metal to be poured into the mold by adding a part of the derived difference in weight between the actual weight of the molten metal in the ladle 5 and the set weight of the molten metal to the set weight of the molten metal to be poured in the mold M. In this embodiment, the part of the difference in weight (between the actual weight of the molten metal in the ladle 5 and the set weight of the molten metal, to be added to the set weight of the molten metal to be poured in the mold M) refers to the following value. Namely, the value would be obtained by dividing the difference in weight (between the actual weight of the molten metal and the set weight of the molten metal) by the number of molds that could be poured by the ladle 5.

As illustrated in FIG. 2, in this embodiment, a mold M to be primarily poured is that with the assigned number 11. On this mold of the assigned number 11, a value that would be obtained by dividing the difference 100 kg in weight (between the actual weight of the molten metal and the set weight of the molten metal) by the number 10 of the molds that could be poured by the ladle 5, i.e., 100 kg/10=10 kg, is added to the set weight of the molten metal to be poured, to derive the target weight of the molten metal to be poured. On the mold of the assigned number 11, because the set weight of the molten metal to be poured is 100 kg, the target weight of the molten metal to be poured would be 100 kg +10 kg=110 kg.

The ladle 5 is then forwardly tilted by means of the tilting means (not shown). Thus, the molten metal is poured into the mold M of the assigned number 11 to target the target weight of the molten metal to be poured. The ladle 5 is then inversely tilted by means of the tilting means (not shown). This movement is controlled by a signal from a pouring circuit in the console 11 for pouring the molten metal to the mold to be poured to target the target weight of the molten metal to be poured.

The group of the molds M is intermittently conveyed in the direction denoted by the arrow Y1, by means of the conveying means (not shown) for conveying the molds such that the group of the molds M is conveyed one pitch (corresponding to the length of one mold). Thus, the following mold M to be subsequently poured would be that of the assigned number 12. On the mold of the assigned number 12, the remaining number of the molds that could be poured by the ladle 5 would be 9. The present actual weight of the molten metal in the ladle 5 would be a value that equals the preceding actual weight of the molten metal in the ladle 5 minus the actual weight of the molten metal to be poured into the mold of the assigned number 11 (see FIG. 2). Namely, the present actual weight of the molten metal in the ladle 5 would be 1,000 kg-108 kg=892 kg. Further, the present set weight of the molten metal in the ladle 5 would be a value that equals the preceding set weight of the molten metal in the ladle 5 minus the set weight of the molten metal to be poured into the mold of the assigned number 11. Namely, the present set weight of the molten metal in the ladle 5 would be 900 kg-100 kg=800 kg. In this case, on the ladle 5, the difference in weight between the actual weight of the molten metal and the set weight of the molten metal would be 892 kg-800 kg=92 kg. Then, a value d that would be obtained by dividing the difference 92 kg in weight by the number 9 of the molds that could be poured by the ladle 5, i.e., the value d=92 kg/9=10.2 kg is added to the set weight of the molten metal to be poured to derive the target weight of the molten metal to be poured. Because the set weight of the molten metal to be poured into the mold of the assigned number 12 is 100 kg, the target weight of the molten metal to be poured would be 100 kg+10.2 kg=110.2 kg.

The ladle 5 is then forwardly tilted by means of the tilting means (not shown) such that the ladle 5 pours the molten metal into the mold M of the assigned number 12 to target the target weight of the molten metal to be poured. The ladle 5 is then inversely tilted by means of the tilting means (not shown). This movement is controlled by a signal from the pouring circuit, in the console 11, for pouring the molten metal to the mold to be poured to target the target weight of the molten metal to be poured.

Thereafter, the molds of the assigned numbers 13 to 20 would be sequentially and intermittently conveyed in the direction denoted by the arrow Y1. The target weights of the molten metal for the molds of the assigned numbers 13 to 20 would be derived similar to the above case on the mold of the assigned number 12. The molten metal is then sequentially poured into the molds M of the assigned numbers 13 to 20, to target the target weight of the molten metal. When the last mold in the numbers of the molds that could be poured by the ladle 5, i.e., the mold M of the assigned number 20, has been poured, the ladle 5 is emptied.

The empty ladle 5 on the second driven roller conveyor 10 is then replaced with another ladle 5 that holds the molten metal. To describe this motion in detail, first, the ladle 5 that holds the molten metal is loaded and ready on the third driven roller conveyor 6, while the first driven roller conveyor 4 is moved to immediate front side of the fourth driven-roller conveyor 7, before pouring of the mold M with the assigned number 20 with the molten metal is completed. When pouring of the mold M of the assigned number 20 with the molten metal is completed, the empty ladle 5 on the second driven-roller conveyor 10 is loaded on the first driven-roller conveyor 4 by passing through above the fourth driven roller conveyor 7. The ladle 5 that holds the molten metal on the third driven roller conveyor 6 is then loaded on the second driven roller conveyor 10 after the second driven-roller conveyor 10 is moved to behind the third driven-roller conveyor 6. The empty ladle 5 on the first driven-roller conveyor 10 will return to outside the melting furnace 1.

After the empty ladle 5 on the second driven-roller conveyor 10 is thus replaced with the filled ladle 5 that holds the molten metal, the filled ladle 5 will repeatedly pour the molten metal into molds of a number of pieces that could be poured by the filled ladle 5, similar to the above embodiment.

In the present invention, the difference in weight between the actual weight of the molten metal in the ladle 5 and the set weight of the molten metal is divided to the respective molds M of number of pieces that could be poured by that ladle. The value of the divided difference is then added to the set weight of the molten metal to be poured into each mold, to derive the target weight of the molten metal to be poured into each mold such that the ladle 5 pours the molten metal into each mold to target the derived target weight of the molten metal to be poured. Therefore, as a result an advantage in which the ladle 5 would be reliably emptied when the molten metal is poured into the last mold in the molds of number of pieces that could be poured by the ladle 5. Thus, the occurring of residual molten metal in the ladle 5 can be inhibited and thus the molten metal to be discharged therefrom is eliminated.

Although the automatic pouring method and the equipment for the same of the present invention are described on the specified embodiment, the present invention is not intended to be limited to it. For instance, in the above embodiment, the part of the difference in weight between the actual weight of the molten metal in the ladle 5 and the set weight of the molten metal, to be added to the set weight of the molten metal to be poured in the mold M refers to the value d that is derived by dividing the above difference in weight by number of pieces of molds that could be poured by the ladle 5. However, the present invention is not intended to be limited to this embodiment. If, for instance, the ladle 5 empties when it pours the molten metal into the last mold in the number of pieces of molds that could be poured by that ladle 5, the value d may be replaced with another value. However, the value d that is derived by the described procedure in the embodiment is more preferably used such that the difference in weight between the actual weight of the molten metal in the ladle 5 and the set weight of the molten metal can be accurately divided to number of pieces of the respective molds M that could be poured by that ladle. Adding the value of the divided difference to the set weight of the molten metal to be poured into each mold enables the derivation of the target weight of the molten metal to be poured into each mold. Thus, the variability of the target weights of the molten metal per to be poured into the respective molds is preferably reduced.

Although the above embodiment illustrates one example in that the present invention is applied on the pouring of the tight-flask molds that are molded from the horizontally parted tight-flask molding machine, the present invention is not intended to be limited to it but may be applicable on a pouring of, for instance, a flasklless mold that is molded from a horizontally parted flaskless molding machine or a longitudinal flaskless molding machine.

The invention claimed is:

1. An automatic pouring method using an automatic pouring machine for tilting a ladle that stores molten metal therein to pour the molten metal therefrom into a specified mold of a group of molds that are intermittently conveyed and a controlling means for controlling the automatic pouring machine, the automatic pouring method comprising the steps of:

providing data on assigned numbers of the respective molds to be poured in the group of the molds, types of products to be cast, and set weights of the molten metal to be poured, to the controlling means;

determining a set weight of the molten metal to be received by the ladle and the number of pieces of the molds that could be poured with the ladle by means of the controlling means based on the provided data on the assigned numbers of the respective molds to be poured in the group of the molds, the types of products to be cast, and the set weights of the molten metal to be poured;

receiving a weight of the molten metal that is greater than the set weight of the molten metal in the ladle;

deriving the difference in weight between the actual weight of the molten metal that is received in the ladle and the set weight of the molten metal in the ladle;

deriving the target weight of the molten metal to be poured by adding a part of the derived difference in weight between the actual weight of the molten metal in the ladle and the set weight of the molten metal in the ladle to the set weight of the molten metal to be poured into the mold to be poured;

tilting the ladle to pour the molten metal into the mold to be poured to target the target weight of the molten metal to be poured; and repeating the pouring of the molten metal a number of times that equals to the number of pieces of the molds that could be poured with the ladle, thereby the ladle would be emptied when the last mold in the number of pieces of the molds that could be poured with the ladle is poured.

2. The automatic pouring method of claim 1, wherein the part of the difference in weight between the actual weight of the molten metal in the ladle and the set weight of the molten metal in the ladle, to be added to the set weight of the molten metal to be poured into the mold to be poured refers to a value that is obtained by dividing the difference in weight between the actual weight of the molten metal in the ladle and the set weight of the molten metal in the ladle by the number of pieces of the molds that could be poured with the ladle.

3. Automatic pouring equipment for automatic pouring molten metal comprising:

a melting furnace for melting each of various metals into molten metal;

an automatic pouring machine for tilting a ladle that storages molten metal therein to pour the molten metal therefrom into a specified mold of a group of molds that are intermittently conveyed;

a truck for conveying the ladle between the melting furnace and the automatic pouring machine; and a controlling means for controlling the melting furnace, the truck, and the automatic pouring machine;

characterized in that the controlling means comprises:

an input circuit for receiving data on assigned numbers of the respective molds to be poured in the group of the molds, types of products to be cast, and set weights of the molten metal to be poured, to the controlling means;

a decision circuit for determining a set weight of the molten metal to be received by the ladle and number of pieces of the molds that could be poured with the ladle based on the provided data on the assigned numbers of the respective molds to be poured in the group of the molds, the types of products to be cast, and the set weights of the molten metal to be poured;

a controlling circuit for controlling a tilting motion of the melting furnace such that the ladle receives therefrom the molten metal by the set weight of the molten metal;

a first arithmetic circuit for deriving the difference in weight between the actual weight of the molten metal that is received in the ladle and the set weight of the molten metal to be received in the ladle;

a second arithmetic circuit for deriving the target weight of the molten metal to be poured by adding a part of the derived difference in weight between the actual weight of the molten metal in the ladle and the set weight of the molten metal to be received in the ladle to the set weight of the molten metal to be poured into the mold to be poured; and a pouring circuit for tilting the ladle to pour the molten metal into the mold to be poured to target the target weight of the molten metal to be poured; and wherein the pouring of the molten metal is repeated a number of times that equals to the number of pieces of the molds that could be poured with the ladle, thereby the ladle would be emptied when the last mold in the number of pieces of the molds that could be poured with the ladle is poured.

4. The automatic pouring equipment of claim 3, wherein the part of the difference in weight between the actual weight of the molten metal in the ladle and the set weight of the molten metal in the ladle, to be added to the set weight of the molten metal to be poured into the mold to be poured refers to a value that is obtained by dividing the difference in weight between the actual weight of the molten metal in the ladle and the set weight of the molten metal in the ladle by the number of pieces of the molds that could be poured with the ladle.

5. The automatic pouring equipment of claim 3, wherein the truck for conveying the ladle includes a weight-measuring means for measuring the weight of the molten metal in the ladle and a first driven-roller conveyor on which the ladle would be loaded on and loaded off.

6. The automatic pouring equipment of claim 3, wherein the automatic pouring machine includes a weight-measuring means for measuring the weight of the molten metal in the ladle and a second driven-roller conveyor on which the ladle would be loaded on and loaded off.

7. The automatic pouring equipment of claim 3 further comprising:

first rails that are laid on outside the melting furnace;

a third driven-roller conveyor and a fourth driven-roller conveyor both are laid on outside the first rails; and a second rails that are laid on outside the third driven-roller conveyor and the fourth driven-roller conveyor; and wherein the truck is moveably loaded on the first rails and the automatic pouring machine is moveably loaded on the second rails.

* * * * *